US005134768A

United States Patent [19]

Tokura

[11] Patent Number: 5,134,768

[45] Date of Patent: Aug. 4, 1992

[54] APPARATUS FOR AUTOMATICALLY MOUNTING AND REMOVING REPLACEMENT PINS FOR PIPE EXPANDING MANDRELS

[75] Inventor: Kenji Tokura, Osaka, Japan

[73] Assignee: Kyoshin Kogyo Kabushiki Kaisha, Osaka, Japan

[21] Appl. No.: 608,220

[22] Filed: Nov. 2, 1990

[30] Foreign Application Priority Data

Mar. 9, 1990 [JP] Japan ..... 2-24078[U]

[51] Int. Cl.[5] ..... B23Q 3/155

[52] U.S. Cl. ..... 483/69; 29/727; 483/28

[58] Field of Search ..... 29/727, 784, 786, 799, 29/235, 568

[56] References Cited

U.S. PATENT DOCUMENTS 4,597,171 7/1986 Kitayama et al. ..... 29/727
4,858,296 8/1989 Gray ..... 29/727 X
4,901,551 2/1990 Widart ..... 29/727 X

FOREIGN PATENT DOCUMENTS 092428 6/1986 Japan .
184630 11/1988 Japan .

*Primary Examiner*—Z. R. Bilinsky
*Attorney, Agent, or Firm*—Koda and Androlia

[57] ABSTRACT

The invention relates to an apparatus for automatically mounting and removing replacement pins for an attachment fixture to be mounted to a pipe expanding apparatus. The apparatus enables quick mounting and removal of replacement pins according to various different patterns formed in the attachment fixture and thus provides improved operating efficiency and improved productivity in connection with pattern changing.

6 Claims, 5 Drawing Sheets

APPARATUS FOR AUTOMATICALLY MOUNTING AND REMOVING REPLACEMENT PINS FOR PIPE EXPANDING MANDRELS

BACKGROUND OF THE INVENTION

1. Field of the Invention

The present invention relates to an apparatus for automatically mounting and removing replacement pins to and from a mandrel attachment fixture which is to be mounted to a pipe expanding apparatus for pushing pipe expanding mandrels during heat exchanger pipe expanding operation.

2. Description of the Prior Art

Hitherto, arrangements of the type having a mandrel attachment fixture for replacement pin mounting for use in pipe-expanding mandrel pushing operation have been known. Examples of such arrangements are described in Japanese Utility Model Application Laid-Open Publication No. 61-092428 and Japanese Utility Model Application Laid-Open Publication No. 63-184630.

The arrangement described in the first mentioned publication, as FIG. 4 (*b*) shows, comprises a pin body 14 insertable into a mandrel receiving through-hole 13 formed in a attachment fixture 12, a collar-shaped stepped portion 16 formed at one end of the pin body 14 for abutment with a lower stepped portion 15 formed in a lower portion of the mandrel receiving through-hole 13 and having a diameter larger than the diameter of the pin body 14, and a locking portion 19 formed at one end of the pin body 14 for engagement with a locking member 17 for locking the pin body 14 to the attachment fixture 12 when the pin body 14 is fitted in the mandrel receiving through-hole 13.

It is noted that, in this prior art arrangement, the attachment fixture 12 is of a two-piece construction, that is, it has upper and lower members 12*a*, 12*b*. For the purpose of pin locking, the upper and lower members 12*a*, 12*b* are first parted from each other, and then the pin body 14 is inserted through the mandrel receiving through-hole 13 of the lower attachment fixture member 12*b*.

Then, the locking member 17 is fitted on the locking portion 19 of the pin body 14 projecting upward from the lower push attachment member 12*b*, whereby the bin body 14 is locked to the lower push attachment member 12*b*. Subsequently, the upper push attachment member 12*a* is removably fitted to the lower member 12*b*. In this way, the pin body 14 can be removably fitted in position. It is noted that mandrel receiving through-holes 13 are provided in plurality so that pin bodies 14 can be removably inserted in suitably selected through-holes 13.

The arrangement described in the latter mentioned publication, as FIG. 5 shows, includes a first locking portion (collar portion) 23 adapted to abut the inner wall or entry-side opening edge of a mandrel receiving through-hole 21 of a pattern plate (push attachment) 20 when a pin body 22 is inserted into the mandrel receiving through-hole 21, to thereby prevent the pin body 22 from moving upward, a tapered face 26 of a tapered cylindrical configuration formed at the forward end of the pin body 22, with a body portion 25 having a hollow interior portion 24 which is defined between the locking portion 23 and the tapered face 26, and a plurality of slits formed in spaced relation on the tapered face 26 and extending along the direction in which the pin body 22 is inserted. On the border between the tapered face 26 and the body portion 25 there is formed a second locking portion 28 having a reverse tapered slope relative to the tapered face 26.

According to this arrangement, it is possible to insert the pin body 22, with the top end or the tapered face 26 as the leading side, into the mandrel receiving through-hole 21 of the pattern plate 20 through the lower opening thereof, and to lock the pin body 22 to the mandrel receiving through-hole 21 through the locking portions 23, 28 of the pin body 22.

In either of the above mentioned prior art apparatuses, it is possible to freely change the arrangement of pin bodies to be suitably fitted into individual mandrel receiving through-holes, in various different patterns to match the arrangement of pipes to be expanded.

SUMMARY OF THE INVENTION

On the other hand, however, the prior art arrangements had the following drawbacks.

(1) In the former arrangement shown in FIG. 4 (*b*), a locking member 17 is used for locking each pin body 14 to the push attachment 12, and therefore the push attachment 12 must be of a two-piece (12*a*, 12*b*) construction. In order to lock the two portions (12*a*, 12*b*) of the push attachment 12 integrally together, locking means, such as bolts 12*c*, 12*c*, are required. This means a larger number of parts, which results in increased cost, and a larger number of stages involved in the assembly process, which in turn means more complex work involved in the replacement of pin bodies 14.

(2) The latter arrangement shown in FIG. 5 requires no such locking element 22 for locking each pin body 22 to the pattern plate (push attachment) 20 as is used in the former arrangement.

Therefore, the pattern plate 20 can be comprised of only one plate body.

This means a smaller number of parts, reduced cost, and a smaller number of stages involved in the assembly process, and accordingly some of the problems in the former arrangement can be eliminated.

However, since the latter mentioned prior art arrangement is such that the body portion 25 of the pin body 22, the interior of which defines the hollow portion 24, can be forcibly diametrically contracted so as to enable the pin body 22 to be inserted into and removed from the pattern plate 20 through such forced diametrical contraction and the tapered portions 26, 28 formed on the outer periphery of the body portion 25 at one end thereof, considerable pressing force is required for such forced diametrical contraction of the body portion 25 of the pin body 22 in connection with inserting and removing the pin body 22 into and from the pattern plate 20.

The fact that the insertion and removal of the pin body 22 can be effected by diametrically contracting the body portion 25 through the tapered portions 26, 28 of the pin body 22 poses another problem.

That is, if the tapered portions 26, 28 are worn away, the sealing capability of the pin body 22 is lost and, therefore, the pin body 22 can no longer be used.

Furthermore, for the mounting to the pipe expanding apparatus of the pattern plate 20 into which the pin body 22 is inserted, laborious transport means using manpower is required. This involves inconveniences, such as increased fatigue of the operator and reduced operating efficiency.

In any case, both the former and the latter arrangements require troublesome manual operation for mounting and removal of replacement pins, as well as for mounting of the push attachment to the pipe expanding apparatus.

This invention is directed to solving all the foregoing problems with the prior art, and accordingly it is an object of the invention to provide a novel apparatus for automatically mounting and removing replacement pins for a push attachment for pipe expanding mandrels which enables quick and easy mounting of replacement pins in various patterns so as to match mandrel receiving through-holes formed in the push attachment used in pipe -expanding mandrel pushing operation and, at same time, easy mounting and removal of the push attachment to and from a pipe expanding apparatus.

According to one aspect of the invention, there is provided an apparatus for automatically mounting and removing replacement pins for a push attachment for pipe expanding mandrels, wherein the push attachment has a plurality of mandrel receiving through-holes formed therein for fitting replacement pins in position, the mandrel receiving through-holes being adapted to removably receive the replacement pins, said apparatus comprising a pin stocker for storing replacement pins to be inserted into position in corresponding relation to said plurality of mandrel receiving through-holes, and pin lower-end push members arranged up and down movably below said pin stocker for selecting a desired replacement pin from the replacement pins stored in said pin stocker and allowing it to be inserted into a corresponding one of said mandrel receiving through-holes. According to this arrangement, it is possible to effect instantaneous and ready insertion of replacement pins into corresponding mandrel receiving through-holes of the push attachment to be mounted to the pipe expanding apparatus.

In another aspect of the invention, the apparatus for automatically mounting and removing replacement pins for a push attachment for a pipe expanding mandrel further comprises a pin top push unit up and down movably provided in corresponding relation to said plurality of mandrel receiving through-holes in said push attachment for removing inserted replacement pins from corresponding through-holes. According to this arrangement, it is possible to effect instantaneous removal of all the pins inserted in the mandrel receiving through-holes.

In another aspect of the invention, the apparatus for automatically mounting and removing replacement pins for a push attachment for a pipe expanding mandrel further comprises a remove and transfer unit for transporting said push attachment and said pin stocker from a location above said pin lower-end push member to a pipe expanding apparatus and mounting same in position and also for removing said push attachment and said pin stocker from said pipe expanding apparatus and returning same to said location above said pin lower-end push member, said remove and transfer unit being disposed between said automatic replacement-pin mounting and removing apparatus and said pipe expanding apparatus. According to this arrangement, it is possible to effect instantaneous and ready mounting and removal of replacement pins to and from the mandrel receiving through-holes of the push attachment to be mounted to the pipe expanding apparatus, in accordance with various desired patterns for pipe expanding operation. It is also possible to transport a push attachment of any desired pattern to the pipe expanding apparatus and mount same in position.

Further, it is possible to return a used push attachment from the pipe expanding apparatus to the automatic pin mounting and removing apparatus, and to effect instantaneous removal of all the replacement pins from the used pattern of push attachment.

Therefore, the needs for such laborious replacement-pin mounting and removing operations and such laborious transport and mounting operations for replacement-pin fitted push attachments as have conventionally been carried out by manpower are eliminated, whereby reduced worker fatigue and reduced changeover loss can be attained, with the result of considerable improvement in operating efficiency and productivity.

DETAILED DESCRIPTION OF THE PREFERRED EMBODIMENTS

One embodiment of the invention will now be described with reference to the accompanying drawings.

Figure 1:
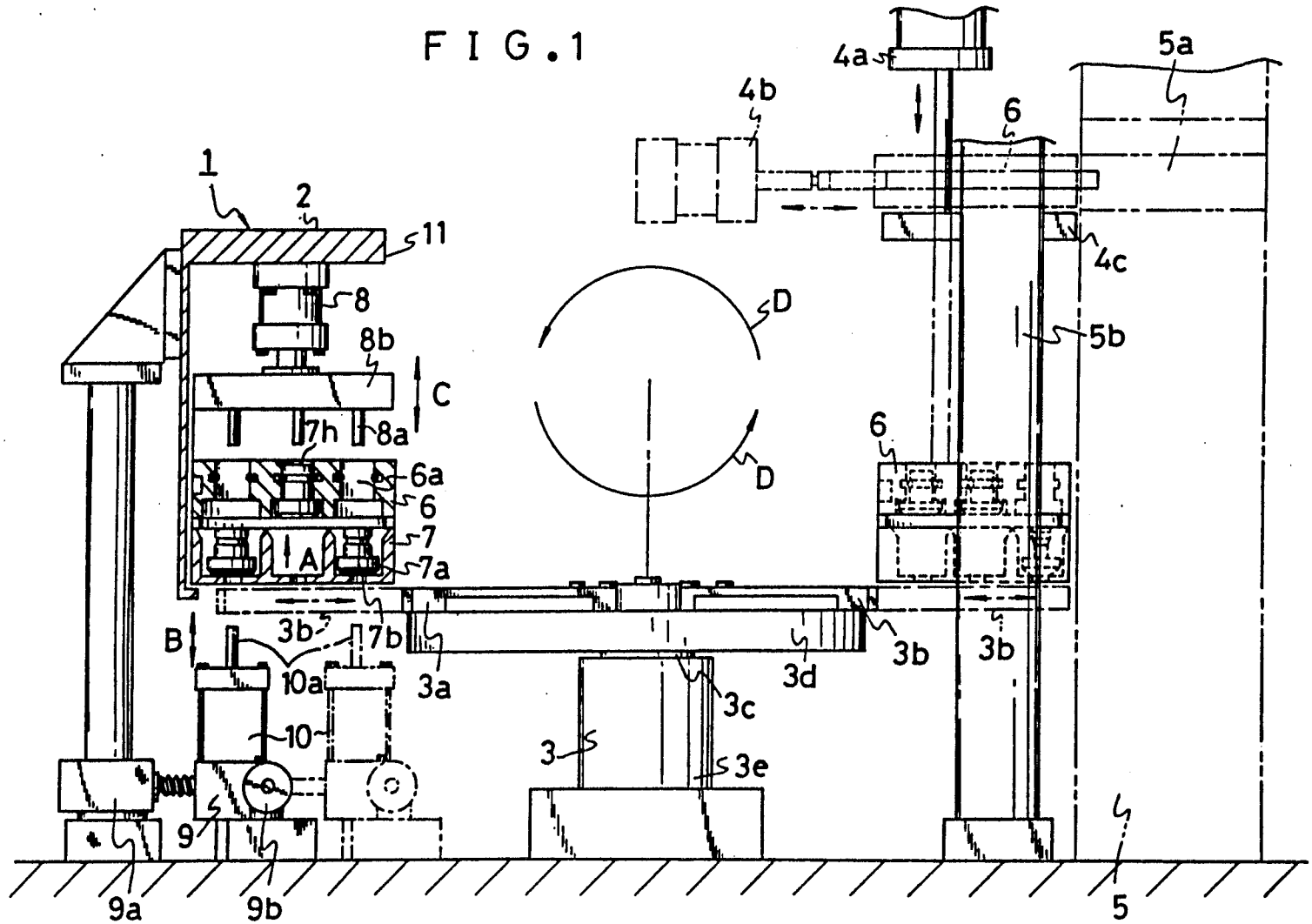
FIG. 1 is a front view showing the entire arrangement of an apparatus according to the invention for automatically mounting and removing replacement pins for a push attachment for a pipe expanding mandrel.

In FIG. 1, numeral 1 generally designates an apparatus for automatically mounting and removing replacement pins for a mandrel attachment fixture for pipe expanding mandrels, which comprises an automatic pin mounting/removing apparatus body 2 and a remove and transfer unit 3.

Figure 2A:
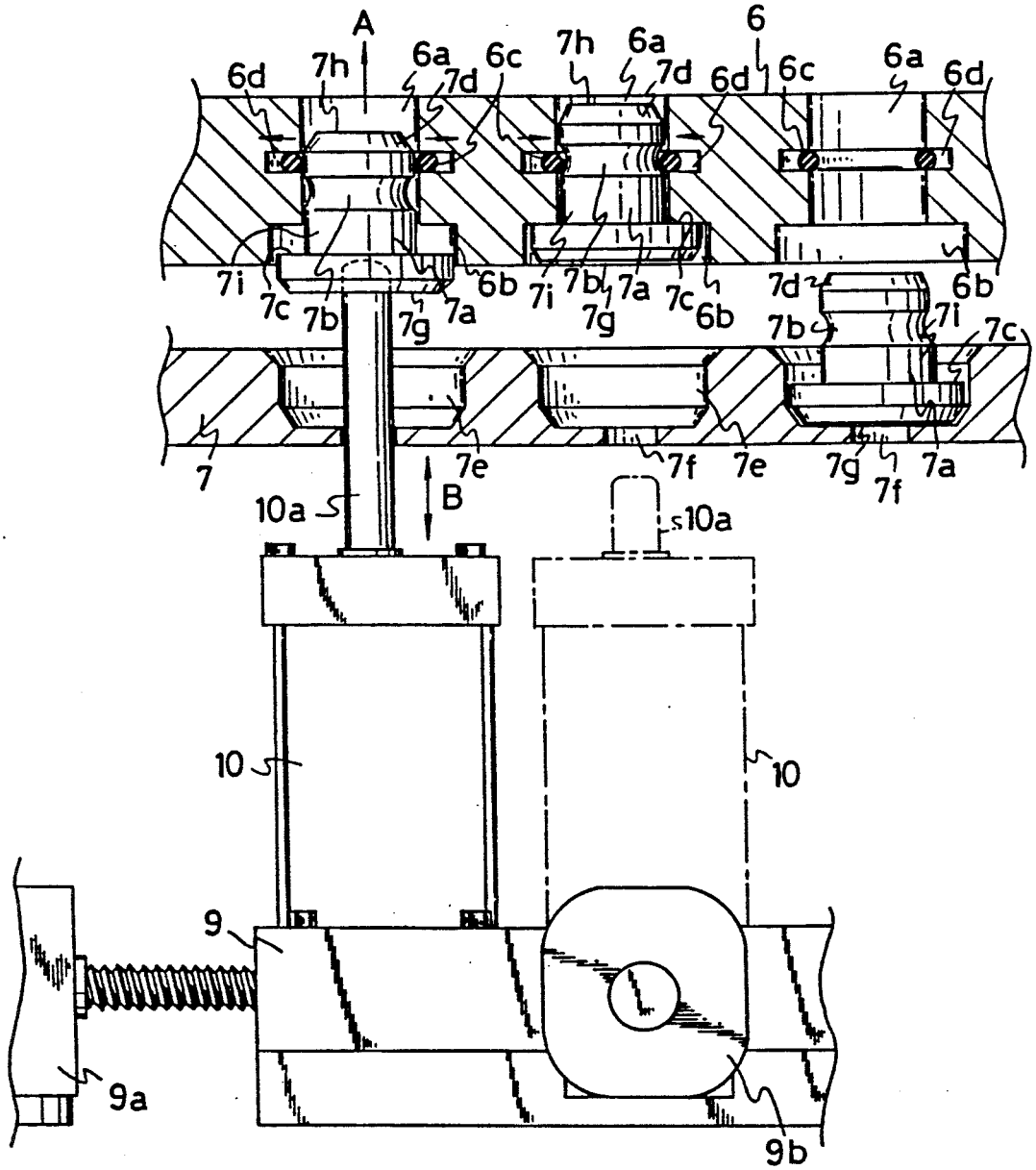
FIGS. 2(*a*), 2(*b*) and 3(*a*), 3(*b*) are explanatory views showing aspects in use of the apparatus for automatically mounting and removing replacement pins for a push attachment for pipe expanding mandrels.
Figure 2B:
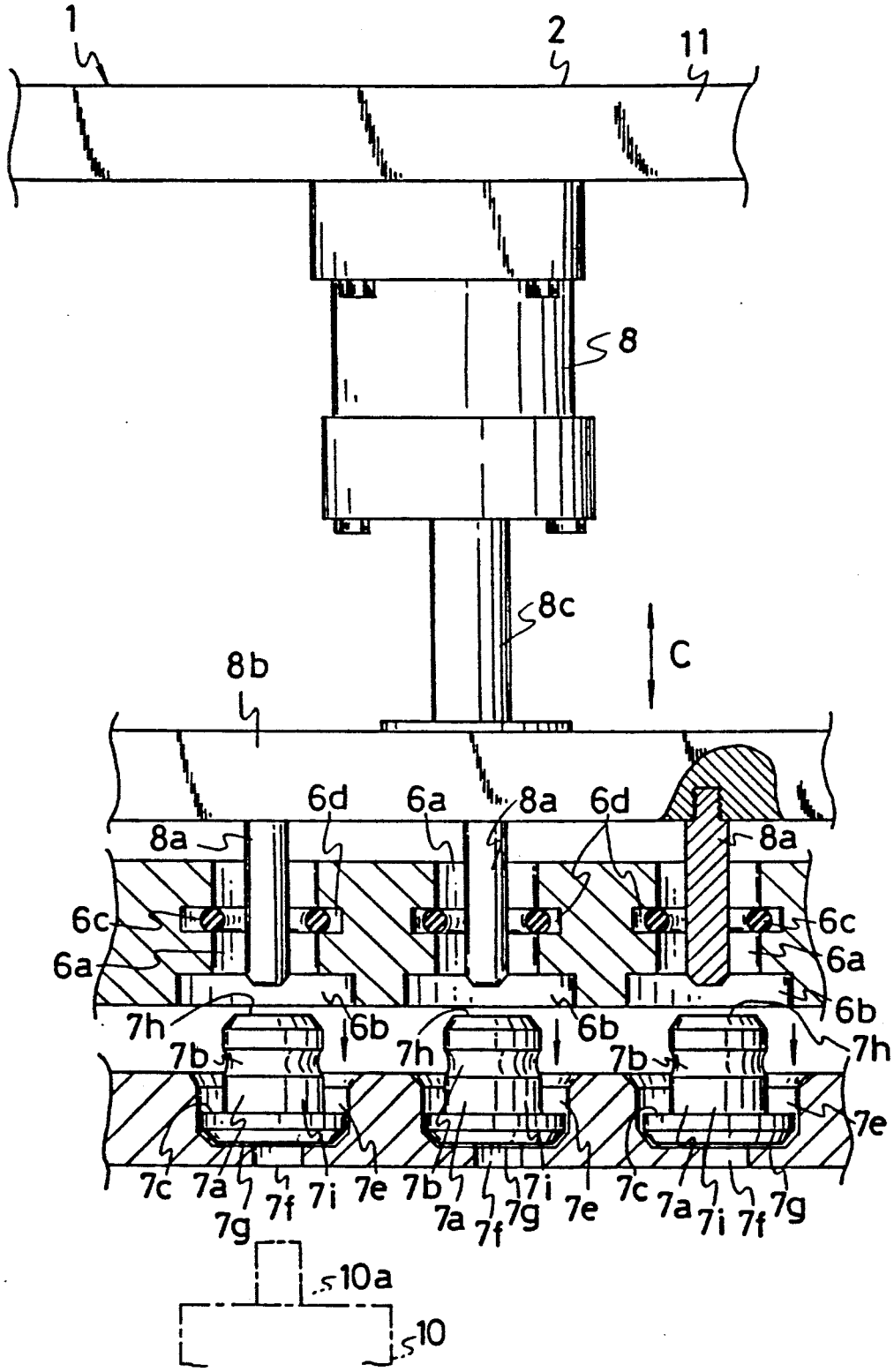

In the apparatus body 2 shown in FIG. 1, reference character 7*a* designates a replacement pin which, as FIG. 2(*a*) shows, comprises a generally cylindrical body 7*i* having a tapered portion at one end, a recessed portion 7*b* formed centrally thereof, the recessed portion 7*b* having a curved surface, and a collar shaped stepped portion 7*c* at the other end.

In FIG. 1, numeral 6 designates a mandrel attachment fixture for removably mounting replacement pins 7*a* in position. The push attachment fixture 6 is formed with a plurality of mandrel receiving through-holes 6*a* arranged in spaced relation, each through-hole 6*a* having a groove portion 6*b* formed at one end for receiving and engaging the stepped portion 7*c* of a replacement pin 7*a* when the pin 7*a* is inserted into the through-hole 6*a*, thereby to regulate the insertion of the pin 7*a* and concurrently to close the through-hole 6*a*. On the inner periphery of the mandrel receiving through-hole 6*a* there is formed an annular groove 6*d* in which is loosely fitted a C-ring adapted to engage the recessed portion 7*b* of the replacement pin body 7*i* for locking the replacement pin 7*a* in position. Numeral 7 designates a pin stocker for storing replacement pins 7*a* which has a plurality of storing portions 7*e* provided in corresponding relation to individual mandrel receiving through-holes 6*a* of the attachment fixture 6, each storing portion 7*e* having a through-hole 7*f* formed in the center of its bottom.

The push attachment 6 and the pin stocker 7 are arranged in such a way that the former overlies the latter, and as can be seen from FIG. 1 they are removably attached to the automatic pin mounting and removing apparatus body 2.

In FIG. 2(*a*), numeral 10 designates a pin lower-end push member of a cylinder configuration disposed below the pin stocker 7 for pushing upward through a through-hole 7*f* a lower end portion 7*g* of a particular replacement pin 7*a* stored in the pin stocker 7, the pin lower-end push member 10 having a rod portion 10*a* adapted to expand and contract (in directions as shown by arrow B). The pin lower-end push member 10 is mounted upright on the top of a table 9 which is movable horizontally in the X-Y directions through servo motors 9*a*, 9*b* disposed on the underside of the table. It is noted that pin lower-end push members 10 are provided in plurality in corresponding relation to the storing portions 7*e* of the pin stocker 7.

In FIG. 2 (*b*), numeral 8 designates a pin top push unit of a cylindrical configuration disposed above the attachment fixture 6 for pushing downward the top 7*h* of each of the replacement pins 7*a* inserted in the mandrel receiving through-hole 6*a* of the attachment fixture 6, the pin top push unit 8 having a rod portion 8*c* adapted to expand and contract (in directions as shown by arrow C), a plate portion 8*b*, and a plurality of rod shaped pin portions 8*a* depending from the plate portion 8*b*. The pin top push unit 8 depends from a beam portion 11 of the automatic pin mounting/removing apparatus body 2.

Figure 3A:
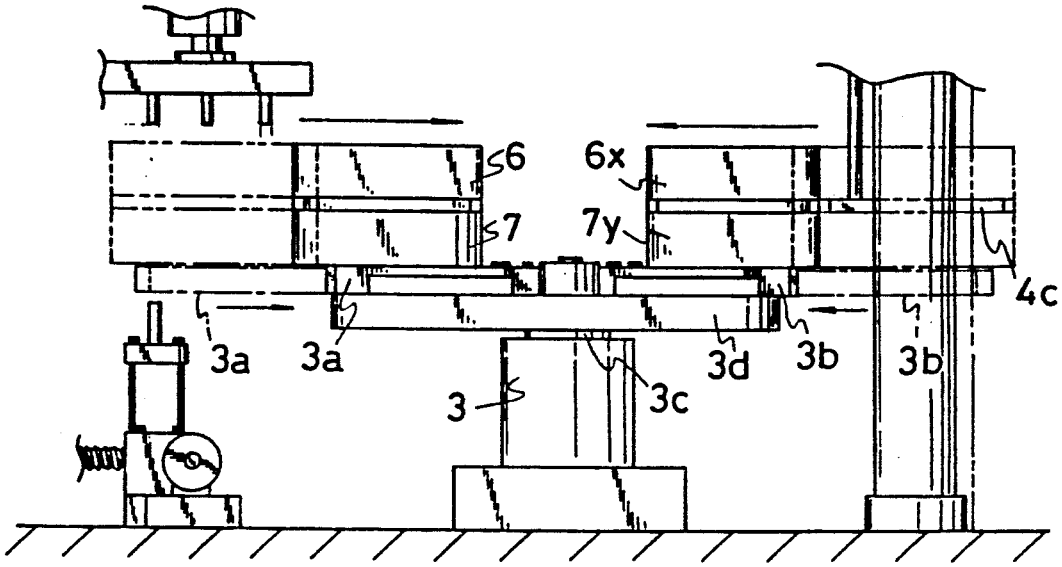
Figure 3B:
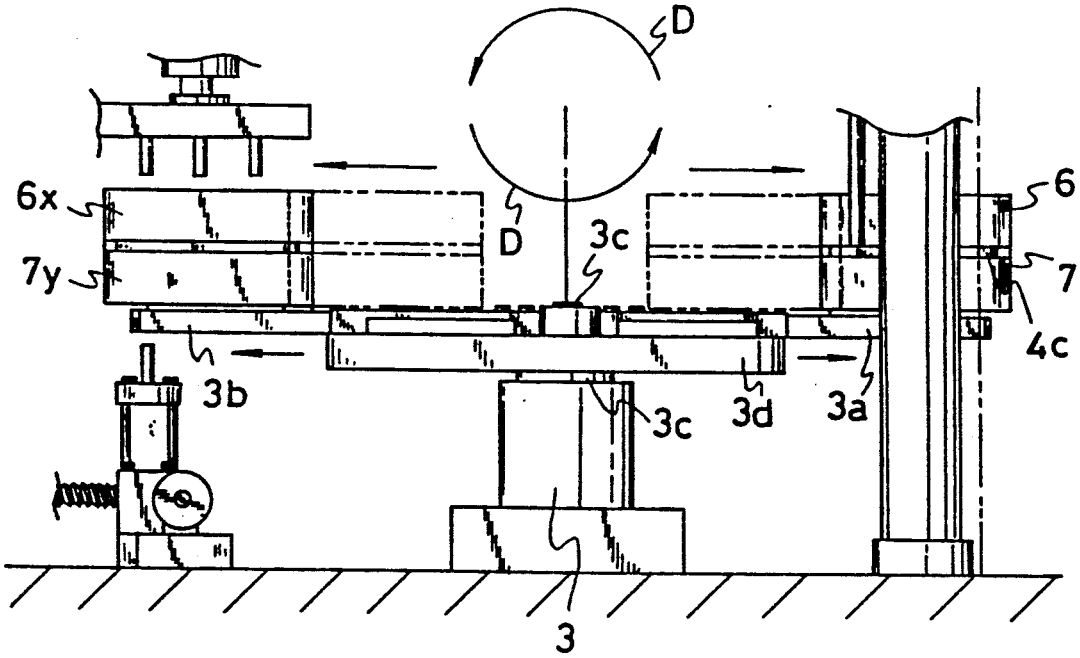
Figure 4A:
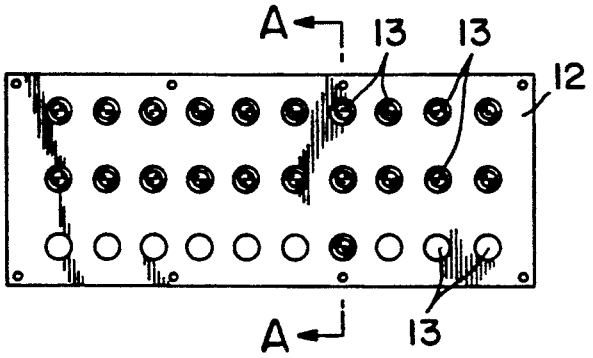
FIG. 4(a) PRIOR ART
FIGS. 4(*a*) and 4(*b*) illustrate the prior art arrangement on which the invention is based, FIG. 4(*a*) being a plan view thereof, and FIG. 4(*b*) being a section taken along line A—A in FIG. 4(*a*)
Figure 4B:
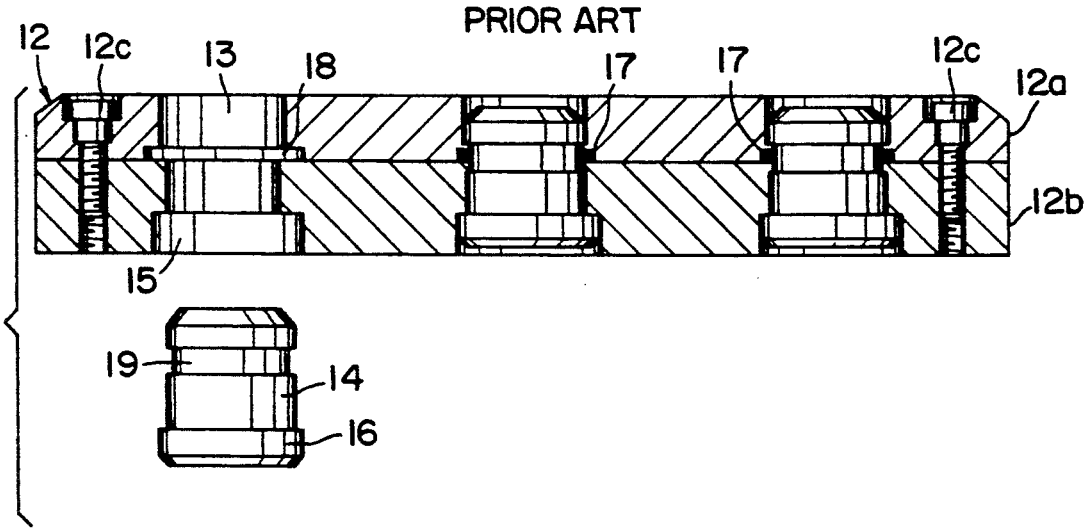
FIG. 4(b) PRIOR ART
Figure 5:
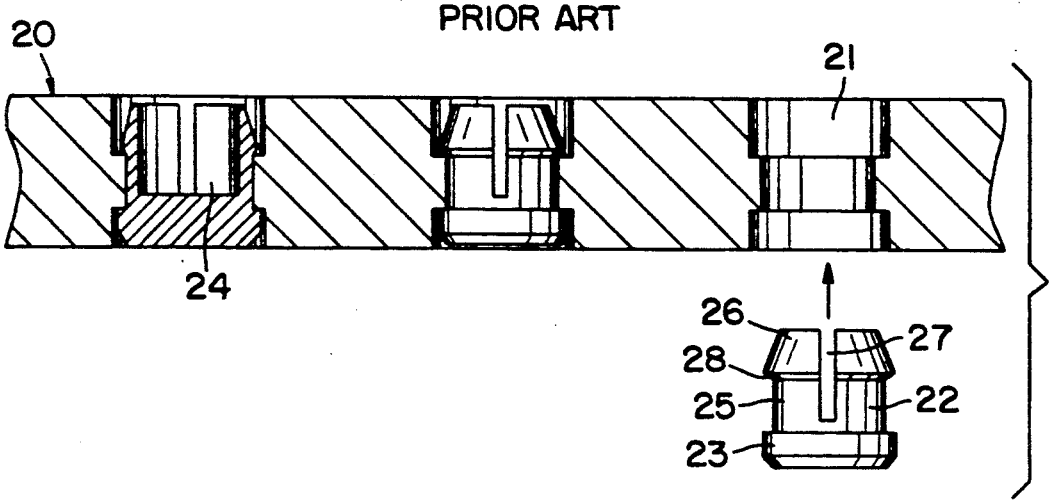
FIG. 5 PRIOR ART
FIG. 5 is a partially enlarged sectional view showing another prior art arrangement.

In FIGS. 1 and 3, the remove and transfer unit 3 is disposed between the automatic pin mounting and removing apparatus body 2 and a pipe expanding apparatus 5. The remove and transfer unit 3 has an arm base 3*d* and a pair of opposed arms 3*a*, 3*b* stretchably disposed thereon, the arm base 3*d* being rotatably supported on a pedestal 3*e* for rotation (in the direction of arrow D) about a shaft 3*c*.

A release guide 4*c* operative to release the attachment fixture 6 from the superposed attachment fixture 6 and pin stocker 7 combination is slidably mounted on a guide shaft 5*b* of the pipe expanding apparatus 5 for slide movement through a vertically movable cylinder 4*a* and a cylinder 4*b* for removably fitting the attachment fixture 6 into a pressing unit 5*a* of the pipe expanding apparatus 5.

The arrangement of the automatic replacement-pin mounting and removing apparatus according to the present embodiment has now been described, and nextly the manner of operation of the apparatus 1 will be explained.

As FIG. 2 (*a*) shows, the table 9 which is disposed below the pin stocker 7 housing replacement pins 7*a* is first shifted to the desired position for pipe expanding operation, and respective rod portions 10*a* of the pin lower-end push members 10 are positioned in corresponding relation to the through-holes 7*f* of the pin stocker 7.

Then, each pin lower-end push member 10 is pressurized. Thereupon, the rod portion 10*a* of the lower-end push member 10 is stretched upward to push up the lower end 7*g* of the replacement pin 7*a* housed in the corresponding storing portion 7*e* of the pin stocker 7.

Thus, the replacement pin pushed upward is removed from the storing portion 7*e* and inserted into the corresponding mandrel receiving through-hole 6*a* of the attachment fixture 6.

Since the leading end of the replacement pin 7*a* has a tapered surface 7*d*, the replacement pin 7*a* is inserted inward while forcing radially outward the C-ring loosely fitted in the mandrel receiving through-hole 6*a*.

Therefore, when the pin 7*a* is inserted until the position of the C-ring is reached by the recessed portion 7*b* of the body 7*i* of the pin 7*a* which has a curved surface, the C-ring 6*c* is allowed to contract radially to engage the replacement pin 7*a*, so that the pin 7*a* can be locked in position within the mandrel receiving through-hole 6*a*.

The attachment fixture 6 of which the replacement pins 7*a* are thus locked in position and the pin stocker 7 are held in superposed condition, the former over the latter, and are removably secured to the automatic replacement-pin mounting and removing apparatus body 2. As FIG. 3(*a*) shows, therefore, they can be released from the apparatus body 2 by expanding and contracting the arm 3*a* of the remove and transfer unit 3.

Simultaneously with this release, the other arm 3*b* which is opposed to the arm 3*a* is expanded and contracted to release a used assembly of attachment fixture 6*x* and pin stocker 7*y* from the pipe expanding apparatus 5.

In the remove and transfer unit 3, the arm base 3*d* equipped with the pair of arms 3*a*, 3*b* is rotatably mounted on the pedestal 3*e* through the shaft 3*c*, and therefore the arm base 3*d* can be rotated 180 degree as shown in FIG. 3(*b*).

By stretching the arms 3*a*, 3*b* after this rotation, therefore, the attachment fixture 6 fitted with replacement pins 7*a* and the pin stocker 7 can be mounted to the pipe expanding apparatus 5 at the desired position for pipe expanding operation, and simultaneously a used assembly of attachment fixture 6*x* and pin stocker 7*y* can be returned to the automatic pin mounting and removing apparatus body 2 for mounting thereto.

The attachment fixture 6*x* and pin stocker 7*y* returned and mounted to the automatic pin mounting and removing apparatus body 2 are then pushed downward by the pin top push unit 8 depending from the beam portion 11, as can be seen from FIG. 2(*b*).

Accordingly, each of the replacement pins 7*a* fitted in position is pushed on its top 7*h* downward by a corresponding pin portion 8*a* so that it is released from the push attachment 6 while forcing the C-ring radially outward again through the curved surface of the recessed portion 7*a* of the pin body 7*i*.

Individual replacement pins 7*a* thus released are fitted back into the corresponding storing portions 7*e* of the pin stocker 7 located below the attachment fixture 6 and are stored therein.

According to the arrangement of this embodiment, therefore, replacement pins 7*a* can be instantaneously fitted into desired mandrel receiving through-holes bored in the attachment fixture 6 to be mounted to the pipe expanding apparatus, the attachment fixture 6 being then transported to the pipe expanding apparatus 5 for mounting thereto. Simultaneously, a used push attachment is returned from the pipe expanding apparatus 5 for suitable replacement pin fitting to meet the pin needs for a next cycle of pipe expanding operation.

According to the invention, therefore, the need for such laborious and inefficient manual pin replacement and for such troublesome process of transport and pin mounting to the pipe expanding as has hitherto been required is eliminated, and thus considerable improvement in operating efficiency can be achieved.

In the foregoing embodiment, the attachment fixture 6 and the pin stocker 7 are mounted to the automatic pin mounting and removing apparatus body 2 while being held in superposed relation, the former over the latter, and the pin lower-end push members 10 are disposed below the pin stocker 7, and the pin top push unit 8 is disposed above the attachment fixture 6; and further the attachment fixture 6 and pin stocker held in superposed relation are adapted to be released from the apparatus body 2 and transferred to the pipe expanding apparatus 5 and, reversely, released from the pipe expanding apparatus 5 and returned to the apparatus body 2. It is understood, however, the invention is not necessarily limited to this arrangement; for example, the attachment fixture 6 and the pin stocker 7 which houses therein replacement pins 7*a* to be fitted into the push attachment may have a push member for fitting the replacement pins 7*a* into the mandrel receiving through-holes 6*a*.

Alternatively, the attachment fixture 6 may have a push member for removing the replacement pins fitted in the attachment fixture 6.

In addition to either alternative, there may be provided a remove and transfer unit.

In the foregoing embodiment, each mandrel receiving through-hole has a ring-shaped groove portion formed on the inner periphery thereof, with a C-ring loosely fitted in the groove portion, and the replacement pin to be fitted into the through-hole is adapted to be locked in position within the through-hole through a curved recessed portion of the body of the pin. It is understood, however, that this does not necessarily limit the construction or configuration of the mandrel receiving through-hole or replacement pin; it is only required in this connection that the replacement pin can be fitted into the mandrel receiving through-hole by pushing the pin from one direction and removed from the through-hole by pushing the pin from the other direction.

Again, in the embodiment, an expansion/contraction cylinder mechanism is employed to actuate the push member for pushing each replacement pin for insertion into the corresponding through-hole and the push member for pushing the replacement pin downward for removal from the through-hole. It is understood, however, that the invention is not necessarily limited by such arrangement; it is only required in this connection that such mechanism provides necessary pressing force for mounting and removing replacement pins to and from the push attachment and is movable upward and downward.

Further, the remove and transfer unit comprising a rotatable arm base and a pair of contractably stretchable arms disposed thereon is employed as means for removing both the push attachment and the pin stocker simultaneously while their being held in superposed condition and transporting same to the pipe expanding apparatus. It is understood, however, that the invention is not limited by this particular arrangement; it is only required in this connection that means having such function is provided between the automatic pin mounting and removing apparatus body and the pipe expanding apparatus to enable smooth removal and transfer of the desired push attachment and a used push attachment for necessary push attachment replacement.

Other details of the arrangement of the invention may be varied, changed or modified within the scope of the invention as defined in the appended claims.

What is claimed is:

1. An apparatus for automatically mounting and removing replacement pins for attaching pipe expanding mandrels to an attachment fixture, wherein the attachment fixture has a plurality of mandrel receiving through-holes formed therein for fitting replacement pins in position, the mandrel receiving through-holes for removably receiving the replacement pins, said apparatus comprising:

a replacement pin stocker for storing replacement pins to be inserted into position in corresponding relation to said plurality of mandrel receiving through-holes, and replacement pin lower-end push members movable up and down from below said replacement pin stocker for selecting a desired replacement pin from the replacement pins stored in said replacement pin stocker and for inserting said replacement pins into a corresponding one of said mandrel receiving through-holes.

2. An apparatus for automatically mounting and removing replacement pins for attaching pipe expanding mandrels to an attachment fixture as set forth in claim 1, further comprising a mandrel remove and transfer unit disposed between said automatic replacement pin mounting and removing apparatus and a pipe expanding apparatus for transporting said attachment fixture with mandrels and said replacement pin stocker from a location above said replacement pin lower-end push members to the pipe expanding apparatus and mounting same to the pipe expanding apparatus and for removing said attachment fixture with mandrels and said replacement pin stocker from the pipe expanding apparatus and returning same to the location above said replacement pin lower-end push members.

3. An apparatus for automatically mounting and removing replacement pins for an attachment fixture for pipe expanding mandrels as set forth in claim 1, further comprising a pin top unit vertically movably disposed above said push attachment fixture for releasing the replacement pins inserted into the plurality of mandrel receiving through-holes bored in said attachment fixture.

4. An apparatus for automatically mounting and removing replacement pins for an attachment fixture for pipe expanding mandrels as set forth in claim 1, further comprising a remove and transfer unit disposed between said automatic replacement-pin mounting and removing apparatus and a pipe expanding apparatus for transporting said attachment fixture and said pin stocker from a location above said pin lower-end push members to the pipe expanding apparatus and mounting same to the pipe expanding apparatus and for removing said attachment fixture and said pin stocker from the pipe expanding apparatus and returning same to the location above said pin lower-end push members.

5. An apparatus for automatically mountings and removing replacement pins for an attachment fixture for pipe expanding mandrels, wherein the attachment fixture has a plurality of mandrel receiving through-holes formed therein for fitting replacement pins in position in said fixture, the mandrel receiving through-holes for removably receiving the replacement pins, said apparatus comprising a pin top push unit vertically movably disposed above said attachment fixture for releasing the replacement pins inserted into the plurality of mandrel receiving through-holes bored in said attachment fixture.

6. An apparatus for automatically mounting and removing replacement pins for an attachment fixture for pipe expanding mandrels as set forth in one of claims 1 to 5, wherein each of the mandrel receiving through-holes bored in said attachment fixture is provided in its interior with a locking member for expanding and contracting as a curved recessed portion formed in a replacement pin body engages and disengages said locking member and to lock said replacement pin to said mandrel receiving through-hole by engaging said recessed portion, said locking member being provided through a groove portion bored in said interior of each of said mandrel receiving through-holes in said attachment fixture.

* * * * *